US005927959A

United States Patent [19]

Johnson

[11] Patent Number: 5,927,959

[45] Date of Patent: Jul. 27, 1999

[54] REPLICA FLAME

[76] Inventor: Jac Nolan Johnson, 316 W. Shepherd St., Nashville, Ark. 71852

[21] Appl. No.: 08/864,214

[22] Filed: May 24, 1997

[51] Int. Cl.[6] ..... F23Q 2/32

[52] U.S. Cl. ..... 431/125; 431/126; 431/289; 362/810

[58] Field of Search ..... 431/125, 126, 431/288, 289, 253; 428/15; 362/392, 457, 806, 810, 161

[56] References Cited

U.S. PATENT DOCUMENTS

| | | | |
|---|---|---|---|
| D. 207,235 | 3/1967 | Lynn . | |
| D. 313,107 | 12/1990 | Maddock . | |
| 1,980,251 | 11/1934 | Becker | 431/125 |
| 2,058,584 | 10/1936 | Gastel | 431/125 |
| 2,154,618 | 4/1939 | Howard | 431/125 |
| 2,367,611 | 1/1945 | Raymond | 431/125 |
| 2,436,995 | 3/1948 | Hamilton | 431/125 |
| 2,465,700 | 3/1949 | Tuttle | 362/810 |
| 2,476,011 | 7/1949 | Wise | 431/125 |
| 2,689,149 | 9/1954 | Saltzman . | |
| 2,723,111 | 11/1955 | Lawrence . | |
| 3,363,436 | 1/1968 | Rutesic | 431/125 |
| 4,680,683 | 7/1987 | Schenke et al. | 431/125 |
| 5,118,196 | 6/1992 | Ault et al. | 362/123 |
| 5,327,332 | 7/1994 | Hafemeister | 362/810 |

FOREIGN PATENT DOCUMENTS

| | | | |
|---|---|---|---|
| 1293606 | 4/1961 | France | 431/125 |

*Primary Examiner*—Ira S. Lazarus
*Assistant Examiner*—Josiah Cocks
*Attorney, Agent, or Firm*—Michael I. Kroll

[57] ABSTRACT

A replica flame (10) for a candle (12) having a wick (14) in a candlestick (16) comprising a simulated three-dimensional flame body (18). A structure (20) is for connecting the simulated three-dimensional flame body (18) to a top end (22) of the candle (12) at the wick (14). It will produce a uniquely realistic appearance for the candle (12) which seems lighted, but is not lighted, thereby making a safe product that will enhance realism to the candle (12).

19 Claims, 2 Drawing Sheets

10
32
18
28
20
24
26

10
34
32
18
36
30
5
28
24
20
26
14
22
12

36
10
24
26
30
18
28
34
20
32
32
10
18
14
34
36
28
22
24
26
20
12

REPLICA FLAME

BACKGROUND OF THE INVENTION

1. Field of the Invention

The instant invention relates generally to vertical holding devices and more specifically it relates to a replica flame. The replica flame is a simulated three-dimensional flame which can be connected to a top end of a candle.

2. Description of the Prior Art

Numerous vertical holding devices have been provided in prior art. For example, U.S. Pat. Nos. 2,689,149 to Saltzman; 2,723,111 to Lawrence; Des. 207,245 to Lynn and Des. 313,107 to Maddock all are illustrative of such prior art. While these units may be suitable for the particular purpose to which they address, they would not be as suitable for the purposes of the present invention as heretofore described.

U.S. Pat. No. 2,689,149 discloses a drinking tube has a flexible laterally extending projection to be rolled or folded till the tube is needed for use. The projection has a notch in one side to engage the rim of the mouth of a bottle into which the tube is inserted. The tube comprises a spiral strip wound into helical turns. The projection has its inner end gripped between the overlapping edges of two adjacent turns of the strip. The strip is in a diagonal position with respect to the turns and extends laterally outward from the body of the tube.

U.S. Pat. No. 2,723,111 discloses a drink-stirring implement of the kind wherein an elongated handle, approximately rectangular in transverse section, has a paddle at one end. The handle and paddle are an integral mass of hard, impervious, shaped-retaining material, characterized in that the paddle is wafer-like having a smooth, flat rear face, located substantially in the plane of the longitudinal axis of the handle. The front face of the paddle is bounded by a forwardly directed rib that defines a field for display of identifying indicia. The forward face of which is in substantially the same plane as the front face of the handle and whose outer edge surface extends rearwardly to the rear face of the paddle and forms the marginal edge of the paddle. The display field has identifying indicia projecting forwardly from the field with its forward face substantially in the plane of the front edge of the rib. The handle is provided with a bead at the end opposite the paddle. That end portion of the handle which is united to the paddle is offset rearwardly from the rear face of the paddle and extends above the lowest point of the paddle.

U.S. Pat. No. Des. 207,245 discloses an ornamental design for a sandwich pick or the like, substantially as shown in the drawings.

U.S. Pat. No. Des. 313,107 discloses an ornamental design for a holder for cookies, as shown and described in the drawings.

SUMMARY OF THE INVENTION

A primary object of the present invention is to provide a replica flame that will overcome the shortcomings of the prior art devices.

Another object is to provide a replica flame that is a simulated three-dimensional flame, which can be connected to a top end of a candle to complete a decorating scheme where a candle is needed.

An additional object is to provide a replica flame that will produce a uniquely realistic appearance for a candle which seems lighted, yet is not lighted, thereby being a safe product that will enhance realism to the candle.

A further object is to provide a replica flame that is simple and easy to use.

A still further object is to provide a replica flame that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DESCRIPTION OF THE PREFERRED EMBODIMENTS

Figure 1:
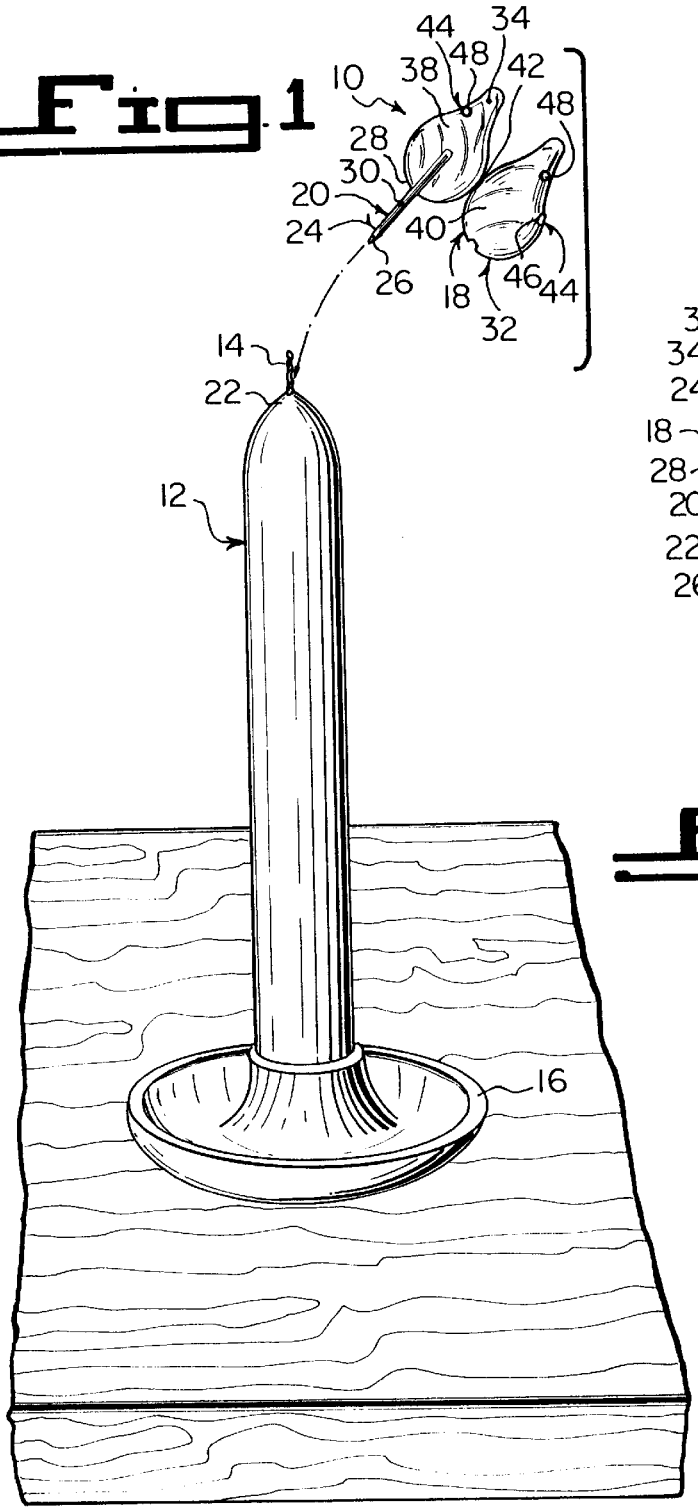
FIG. 1 is a perspective view of a candle in a candlestick, showing a first embodiment of the instant invention having an elongated rigid pin with a pointed tip ready to be inserted into a top end of the candle.

Turning now descriptively to the drawings, in which similar reference characters denote similar elements throughout the several views, FIGS. 1 through 7 illustrate a replica flame 10 of the present invention. With regard to the reference numerals used, the following numbering is used throughout the various drawing figures.

10 replica flame for 12

12 candle

14 wick of 12

16 candlestick for 12

18 simulated three-dimensional flame body of 10

20 connecting structure of 10
22 top end of 12
24 elongated rigid pin for 20
26 pointed tip on 24
28 bottom end of 18
30 material for 24
32 pear shaped member for 18
34 material for 32
36 vertical groove in 32 for 14
38 first equal half segment of 32
40 second equal half segment of 32
42 side hinge between 38 and 40
44 closing facility for 38 and 40
46 clasp for 44 on 40
48 male/female snap closure for 44 on 38 and 40

The replica flame 10 is for a candle 12 having a wick 14 in a candlestick 16, comprising a simulated three-dimensional flame body 18. A structure 20 is for connecting the simulated three-dimensional flame body 18 to a top end 22 of the candle 12 at the wick 14. It will produce a uniquely realistic appearance for the candle 12 which seems lighted, but is not lighted, thereby making a safe product that will enhance realism to the candle 12.

The connecting structure 20 is an elongated rigid pin 24 having a pointed tip 26. The elongated rigid pin 24 extends from a bottom end 28 of the simulated three-dimensional flame body 18. The pointed tip 26 can be inserted into the top end 22 of the candle 12, to retain the simulated three-dimensional flame body 18 thereto. The elongated rigid pin 24 is fabricated out of a material 30 selected from the group consisting of metal, plastic and wood.

The simulated three-dimensional flame body 18 is a pear shaped member 32 having realistic colors of a natural flame duplicated thereon. The pear shaped member 32 can include commercial coloring agents imbedded therein and applied onto an outer surface thereof.

The pear shaped member 32 can further include an additional treatment of glitter material, to optimize realism as if the candle 12 is really burning. The pear shaped member 32 can also further include an additional treatment of fluorescent material to optimize realism as if the candle is really burning.

Figures 4, 5, 6, 7:
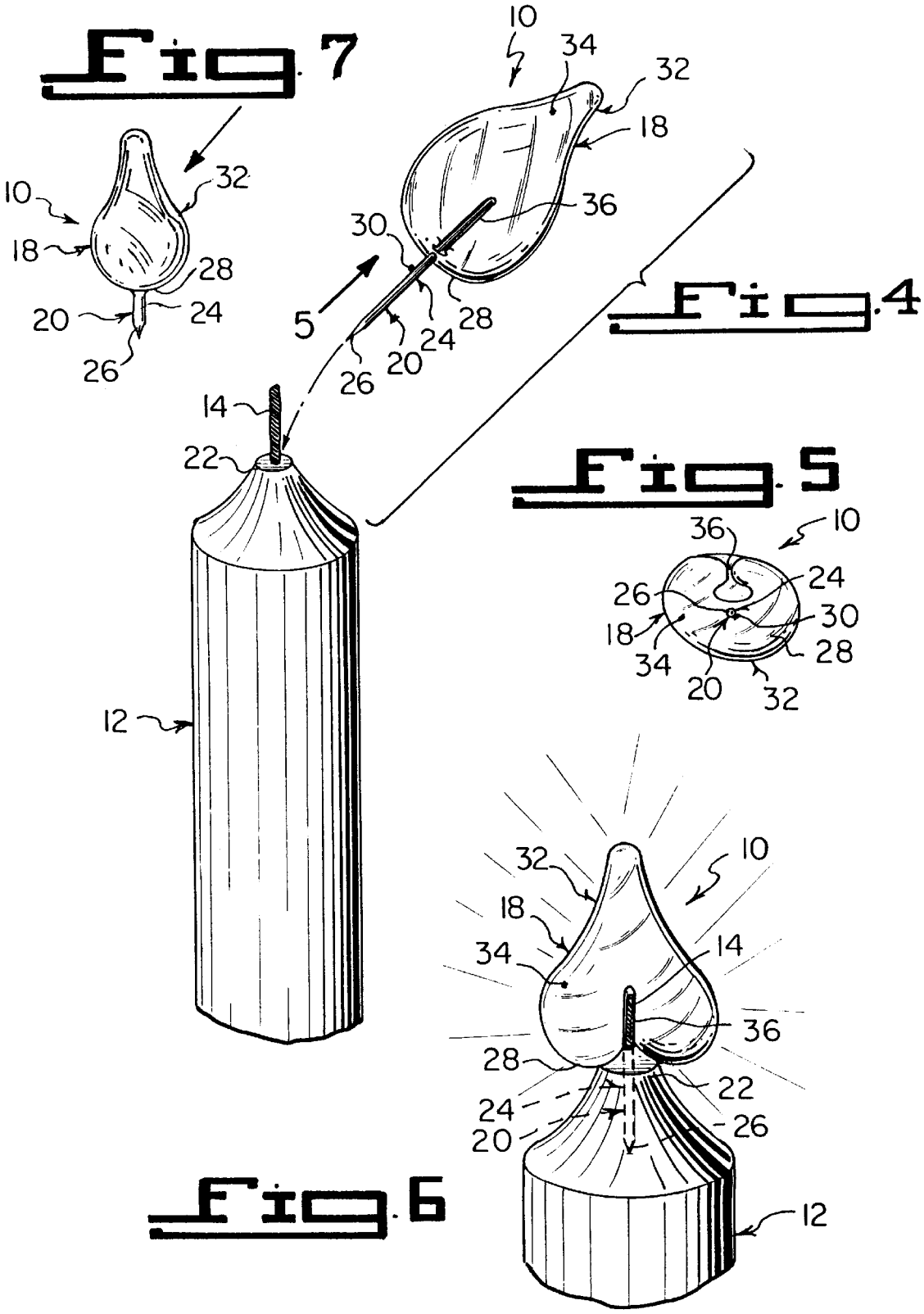
FIG. 4 is a perspective view of an upper portion of a candle, showing a second embodiment of the instant invention having an elongated rigid pin with a pointed tip ready to be inserted into a top end of the candle.
FIG. 5 is a bottom view of the second embodiment taken in the direction of arrow 5 in FIG. 4.
FIG. 6 is a perspective view of the upper portion of the candle, showing the elongated rigid pin of the second embodiment inserted into the top end of the candle and the wick of the candle pressed into a vertical groove on one side of the pair shaped member.
FIG. 7 is an elevational view of a third embodiment of the instant invention per se.

The pear shaped member 32 is fabricated out of a material 34 selected from the group consisting of papier-mache, injected/extruded plastic, ceramic, china, glass, porcelain, plaster, wood and metal. The pear shaped member 32 is constructed by a technique selected from the group consisting of being stamped, formed, molded and casted. As shown in FIGS. 4, 5 and 6, the pear shaped member 32 can have a vertical groove 36 on one side thereof, to receive the wick 14 of the candle 12 after being retained to the top end 22 of the candle 12 by the connecting structure 20.

Figure 2:
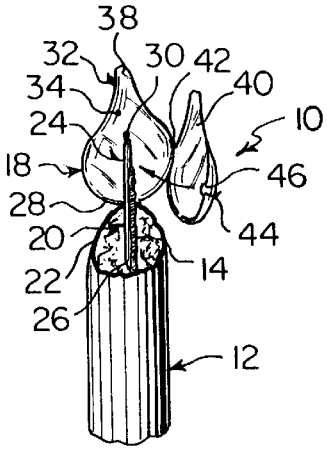
FIG. 2 is a perspective view of an upper portion of the candle with parts broken away, showing the elongated rigid pin of the first embodiment inserted into the top end of the candle.
Figure 3:
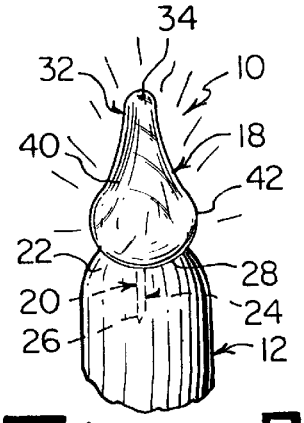
FIG. 3 is a perspective view of the upper portion of the candle, showing the elongated rigid pin of the first embodiment inserted into the top end of the candle and the two equal half segments of the pear shaped member closed about the wick of the candle.

The pear shaped member 32 shown in FIGS. 1, 2 and 3, contains a vertical split therethrough, so as to divide the pear shaped member 32 into two equal half segments 38 and 40. A side hinge 42 is between the two equal half segments 38 and 40. A facility 44 is for closing the two equal half segments 38 and 40 about the wick 14 of the candle 12, after being retained to the top end 22 of the candle 12 by the connecting structure 20.

The closing facility 44 can be a clasp 46 on the half segment 40 of the pear shaped member 32. The closing facility 44 as shown in FIG. 1, can also be a male/female snap closure 48 between the two equal half segments 38 and 40 of the pear shaped member 32. In FIG. 7, the pear shaped member 32 is made without the vertical groove 36, while the elongated rigid pin 24 is integral with and extends from the bottom end 28 thereof.

OPERATION OF THE INVENTION

To use the replica flame 10 the following steps should be taken:

1. Place the base of the candle 12 into the socket of the candlestick 16 that is upon a support surface (see FIG. 1).
2. Insert the pointed tip 26 of the elongated rigid pin 24 into the top end 22 of the candle 12 (see FIGS. 2, 3 and 6).
3. Press the wick 14 into the vertical groove 36 on the side of the pear shaped member 32, if so supplied with the vertical groove 36 (see FIGS. 4, 5 and 6).
4. Position the wick 14 between the two equal half segments 38 and 40, if so supplied with the pear shaped member 32 being vertical split (see FIGS. 1, 2 and 3).
5. Close the half segment 40 against the half segment 38 with the clasp 46, if so supplied with the clasp 46 (see FIGS. 1 and 2).
6. Close the half segment 40 against the half segment 38 with the male/female snap closure 48, if so supplied with the male/female snap closure 48 (see FIG. 1).

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A replica flame for a candle having a wick in a candlestick comprising:

a) a simulated three-dimensional flame body; and b) means for connecting said simulated three-dimensional flame body to a top end of the candle at the wick, so that it will produce a uniquely realistic appearance for the candle which seems lighted, but is not lighted, thereby making a safe product that will enhance realism of the candle, wherein said simulated three-dimensional flame body is a pear-shaped member having realistic colors of a natural flame duplicated thereon, said pear shaped member including:

i) a vertical split therethrough, so as to divide said pear shaped member into two equal half segments;

ii) a side hinge between said two equal half segments; and iii) means for closing said two equal half segments about the wick of the candle after being retained to the top end of the candle by said connecting means.

2. A replica flame as recited in claim 1, wherein said connecting means is an elongated rigid pin having a pointed tip, said elongated rigid pin extends from a bottom end of said simulated three-dimensional flame body, so that said pointed tip can be inserted into the top end of the candle to retain said simulated three-dimensional flame body thereto.

3. A replica flame as recited in claim 2, wherein said elongated rigid pin is fabricated out of a material selected from the group consisting of metal, plastic and wood.

4. A replica flame as recited in claim 1, wherein said pear shaped member includes commercial coloring agents imbedded therein and applied onto an outer surface thereof.

5. A replica flame as recited in claim 1, wherein said pear shaped member further includes an additional treatment of glitter material, to optimize realism as if the candle is really burning.

6. A replica flame as recited in claim 1, wherein said pear shaped member further includes an additional treatment of fluorescent material to optimize realism as if the candle is really burning.

7. A replica flame as recited in claim 1, wherein said pear shaped member is fabricated out of a material selected from the group consisting of papier-mache, injected/extruded plastic, ceramic, china, glass, porcelain, plaster, wood and metal.

8. A replica flame as recited in claim 1, wherein said pear shaped member is constructed by a technique selected from the group consisting of being stamped, formed, molded and casted.

9. A replica flame as recited in claim 1, further including said pear shaped member having a vertical groove on one side thereof, to receive the wick of the candle after being retained to the top end of the candle by said connecting means.

10. A replica flame as recited in claim 1, wherein said closing means is a clasp on one said half segment of said pear shaped member.

11. A replica flame as recited in claim 1, wherein said closing means is a male/female snap closure between said two equal half segments of said pear shaped member.

12. A replica flame as recited in claim 2, wherein said pear shaped member includes commercial coloring agents imbedded therein and applied onto an outer surface thereof.

13. A replica flame as recited in claim 12, wherein said pear shaped member further includes an additional treatment of glitter material, to optimize realism as if the candle is really burning.

14. A replica flame as recited in claim 13, wherein said pear shaped member further includes an additional treatment of fluorescent material to optimize realism as if the candle is really burning.

15. A replica flame as recited in claim 14, wherein said pear shaped member is fabricated out of a material selected from the group consisting of papier-mache, injected/extruded plastic, ceramic, china, glass, porcelain, plaster, wood and metal.

16. A replica flame as recited in claim 15, wherein said pear shaped member is constructed by a technique selected from the group consisting of being stamped, formed, molded and casted.

17. A replica flame as recited in claim 16, further including said pear shaped member having a vertical groove on one side thereof, to receive the wick of the candle after being retained to the top end of the candle by said connecting means.

18. A replica flame as recited in claim 16, wherein said closing means is a clasp on one said half segment of said pear shaped member.

19. A replica flame as recited in claim 16, wherein said closing means is a male/female snap closure between said two equal half segments of said pear shaped member.

* * * * *